US007371111B2

(12) United States Patent
McCarthy et al.

(10) Patent No.: US 7,371,111 B2
(45) Date of Patent: May 13, 2008

(54) COAXIAL CABLE CONNECTOR WITH IMPROVED SHIELDING

(75) Inventors: Sean Patrick McCarthy, Palmyra, PA (US); Charles Randall Malstrom, Lebanon, PA (US); Michael Fredrick Laub, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 57 days.

(21) Appl. No.: 11/267,951

(22) Filed: Nov. 4, 2005

(65) Prior Publication Data

US 2006/0073733 A1 Apr. 6, 2006

Related U.S. Application Data

(62) Division of application No. 10/791,245, filed on Mar. 2, 2004, now Pat. No. 6,988,911.

(51) Int. Cl.
*H01R 13/60* (2006.01)

(52) U.S. Cl. ..... 439/578

(58) Field of Classification Search ..... 439/578, 439/585, 610, 98, 538, 394
See application file for complete search history.

(56) References Cited

U.S. PATENT DOCUMENTS

| | | | | | |
|---|---|---|---|---|---|
| 5,232,380 | A * | 8/1993 | Inoue et al. | ..... | 439/610 |
| 5,399,097 | A * | 3/1995 | Sakai et al. | ..... | 439/395 |
| 5,409,400 | A * | 4/1995 | Davis | ..... | 439/610 |
| 5,725,395 | A * | 3/1998 | Lee | ..... | 439/610 |
| 5,924,887 | A * | 7/1999 | Aoyama et al. | ..... | 439/400 |
| 6,065,998 | A * | 5/2000 | Peloza | ..... | 439/578 |
| 6,200,162 | B1 * | 3/2001 | Aoyama et al. | ..... | 439/578 |
| 6,384,335 | B1 * | 5/2002 | Saito et al. | ..... | 174/74 R |
| 6,706,970 | B2 * | 3/2004 | Laub et al. | ..... | 174/135 |
| 6,746,268 | B2 * | 6/2004 | Laub et al. | ..... | 439/394 |
| 6,746,277 | B2 * | 6/2004 | Laub et al. | ..... | 439/585 |

* cited by examiner

*Primary Examiner*—Tulsidas C. Patel
*Assistant Examiner*—Phuongchi Nguyen

(57) ABSTRACT

A coaxial cable connector assembly includes a coaxial cable comprising a conductive braid, and a primary shield coupled to the cable and in electrical contact with the conductive braid. The primary shield defines a three sided enclosure surrounding the cable, and a secondary shield defines at least a portion of a fourth side of said enclosure and is electrically connected to the conductive braid.

18 Claims, 12 Drawing Sheets

COAXIAL CABLE CONNECTOR WITH IMPROVED SHIELDING

This application is a divisional of U.S. application Ser. No. 10/791,245, filed Mar. 2, 2004 now U.S. Pat. No. 6,988,911.

CROSS REFERENCE TO RELATED APPLICATIONS

This application is related to U.S. application Ser. No. 10/191,136 now U.S. Pat. No. 6,736,653, titled "Electrical Connector Assembly for Coaxial Cables," and U.S. application Ser. No. 10/647,552 now U.S. Pat. No. 6,840,822, titled "Cable Connector", the complete disclosures of which are hereby incorporated by reference in their entirety.

BACKGROUND OF THE INVENTION

This invention relates generally to electrical connector assemblies, and, more specifically, to connector assemblies for coaxial cables.

In the past, connectors have been proposed for interconnecting coaxial cables. Generally, coaxial cables have a circular geometry formed with a central conductor (of one or more conductive wires) surrounded by a cable dielectric material. The dielectric material is surrounded by a cable braid (of one or more conductive wires) that serves as a ground, and the cable braid is surrounded by a cable jacket. In most coaxial cable applications, it is preferable to match the impedance between source and destination electrical components located at opposite ends of the coaxial cable. Consequently, when sections of coaxial cable are interconnected by connector assemblies, it is preferable that the impedance remain matched through the interconnection.

Today, coaxial cables are widely used. Recently, demand has arisen for radio frequency (RF) coaxial cables in applications such as the automotive industry. The demand for RF coaxial cables in the automotive industry is due in part to the increased electrical content within automobiles, such as AM/FM radios, cellular phones, GPS, satellite radios, Blue Tooth™ compatibility systems and the like. The wide applicability of coaxial cables demands that connected coaxial cables maintain the impedance at the interconnection.

Conventional coaxial connector assemblies include matable plug and receptacle housings carrying dielectric subassemblies. The dielectric subassemblies include dielectrics, metal outer shields, and center contacts. The dielectric subassemblies receive and retain coaxial cable ends, and each of the outer shields enclose the dielectrics on three sides thereof. Portion of the shields pierce the cable jackets to electrically contact the cable braids while the center contacts engage the central conductors. The plug and receptacle housings include interior latches that catch and hold the dielectric subassemblies, and thus the coaxial cable ends, therein. When the plug and receptacle housings are mated, the dielectric subassemblies are engaged such that the outer shields are interconnected and the center contacts are interconnected with the dielectrics interconnected therebetween.

BRIEF DESCRIPTION OF THE INVENTION

According to an exemplary embodiment, a coaxial cable connector assembly is provided. The assembly comprises a coaxial cable comprising a conductive braid, and a primary shield coupled to the cable and in electrical contact with the conductive braid. The primary shield defines a three sided enclosure surrounding the cable, and a secondary shield defines at least a portion of a fourth side of the enclosure. The secondary shield is electrically connected to the conductive braid.

Optionally, the primary shield comprises opposite side walls and a connecting wall extending between the side walls, and a portion of at least one of the side walls is folded over a side of the cable opposite the connecting wall to form the secondary shield. Each of the side walls may comprise a secondary shield flap configured for shielding the cable along the fourth side of the enclosure, and a gap may extend between the flaps on the fourth side of the enclosure when the flaps are folded. Alternatively, a secondary shield may be coupled to the primary shield and extend over the cable opposite the connecting wall.

According to another exemplary embodiment, a coaxial cable connector assembly is provided. The assembly comprises a plug assembly configured for mating engagement with a receptacle assembly, and each of the plug assembly and the receptacle assembly configured to receive and connect a coaxial cable thereto. The cable comprises a conductive braid, and at least one of the plug assembly and the receptacle assembly comprising a primary shield coupled to the cable and in electrical contact with the conductive braid. The primary shield comprises opposite side walls and a connecting wall extending surrounding said cable. A secondary shield extends at least partially over the cable opposite the connecting wall.

According to another exemplary embodiment, a coaxial cable connector assembly is provided. The assembly comprises a plug assembly and a receptacle assembly. The plug assembly is configured for mating engagement with the receptacle assembly to connect respective coaxial cables having a conductive braid. At least one of the plug assembly and the receptacle assembly comprises a contact configured for connection to a respective cable, a dielectric configured to receive the contact and a portion of the respective cable, and a primary shield coupled to the respective cable and in electrical contact with the conductive braid. The primary shield comprises opposite side walls and a connecting wall with the cable extending therebetween. A secondary shield extends at least partially over the cable opposite the connecting wall.

DETAILED DESCRIPTION OF THE INVENTION

Figure 1:
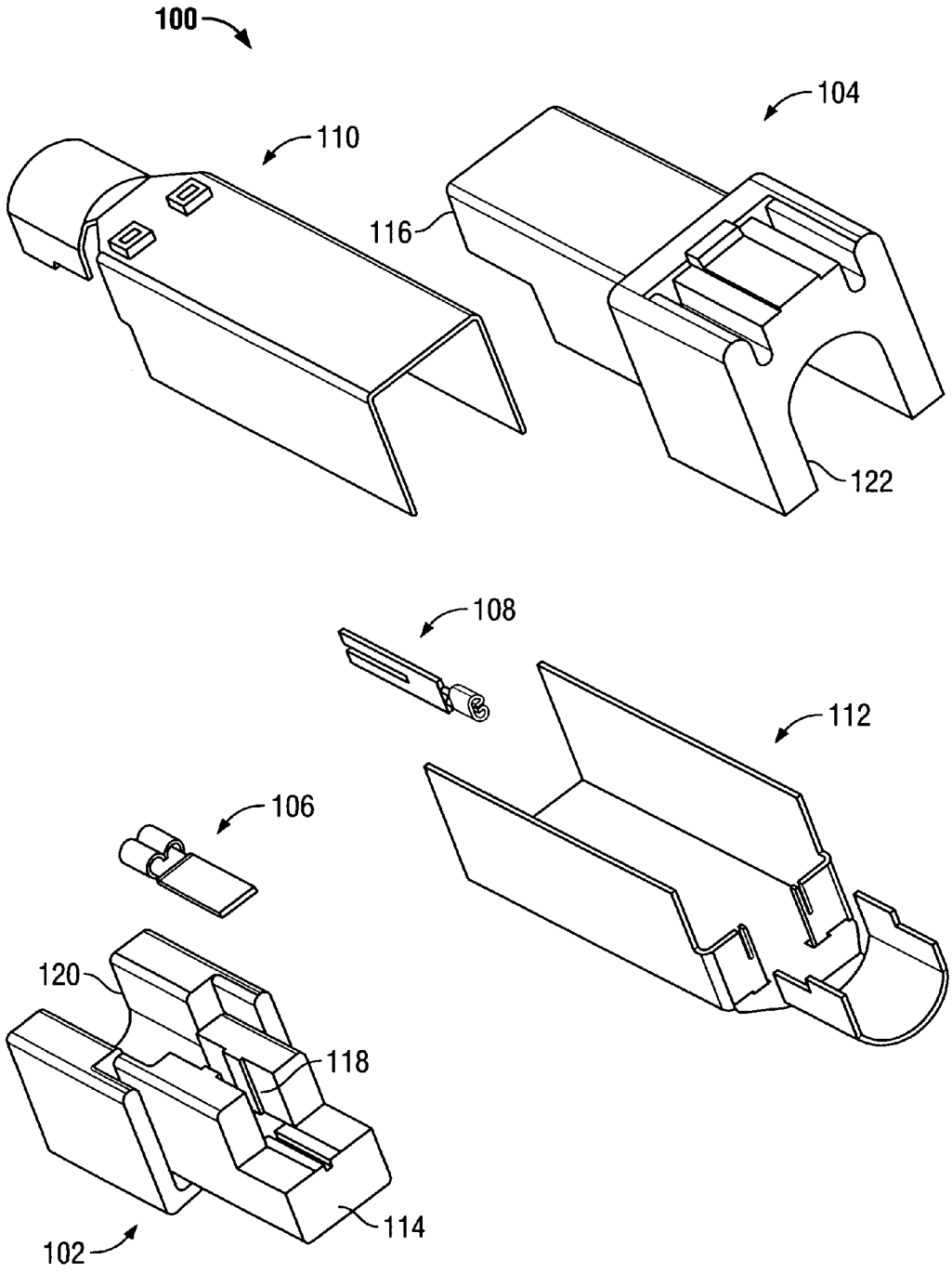
FIG. 1 (Prior Art)
FIG. 1 is an exploded view of a known connector assembly for a coaxial cable.

FIG. 1 illustrates a known coaxial cable connector assembly 100 which is shown to better understand the subject matter of the present invention which is described below. It is understood, however, that the shielding of the present invention may be used generally in various types of coaxial cable connectors. The description set forth below is provided solely for purposes of illustrating the invention, and is not intended to limit the application of the invention to any particular connector.

The coaxial cable connector assembly 100 includes dielectric housings 102 and 104 corresponding to a respective plug and receptacle assembly, a plug contact 106, a receptacle contact 108, a plug shield 110 and a receptacle shield 112. The first and second dielectric housings 102 and 104 include mating faces 114 and 116, respectively, and a slot 118 proximate the mating face 114 accepts a portion of the plug contact 106. Another slot (not shown in FIG. 1) proximate the mating face 116 accepts a portion of the receptacle contact 108. The respective plug and receptacle contacts 106, 108 are crimped to center conductors of respective cables (not shown in FIG. 1), and when the plug is connected to the receptacle the plug contact 106 is electrically connected to the receptacle contact 108. Barrels 120 and 122 are provided in the dielectric housings 102 and 104 which receive the cables, and the shields 110 and 112 are attached to the cables over the dielectric housings 102 and 104.

While the connector assembly 100 is suitable for smaller cable applications, the shields 110 and 112 may benefit from additional mechanical stability and electrical shielding as the size of the cable increases.

Figure 2:
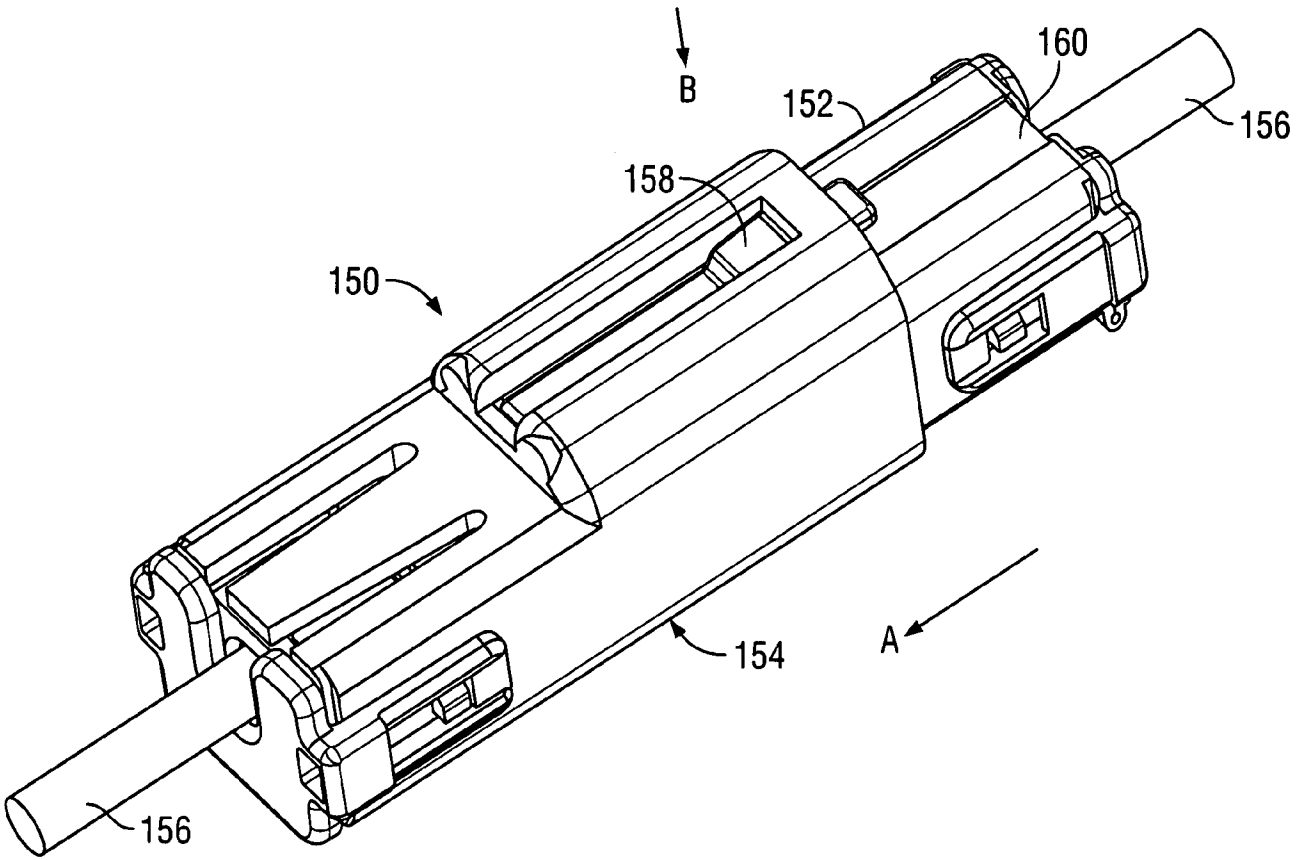
FIG. 2 (Prior Art)
FIG. 2 is a top perspective view of another known electrical connector assembly for a coaxial cable.

FIG. 2 illustrates another known coaxial cable connector assembly 150 which is better suited for larger cable than the connector assembly 100 (shown in FIG. 1). The cable connector assembly 150 includes a plug housing 152 and a receptacle housing 154 that each carry a coaxial cable 156. The receptacle housing 154 slidably receives the plug housing 152 in the direction of arrow A to electrically connect the coaxial cables 156. The plug and receptacle housings 152 and 154 are maintained in mating contact by a deflectable latch 158 extending from a top wall 160 of the plug housing 152.

Figure 3:
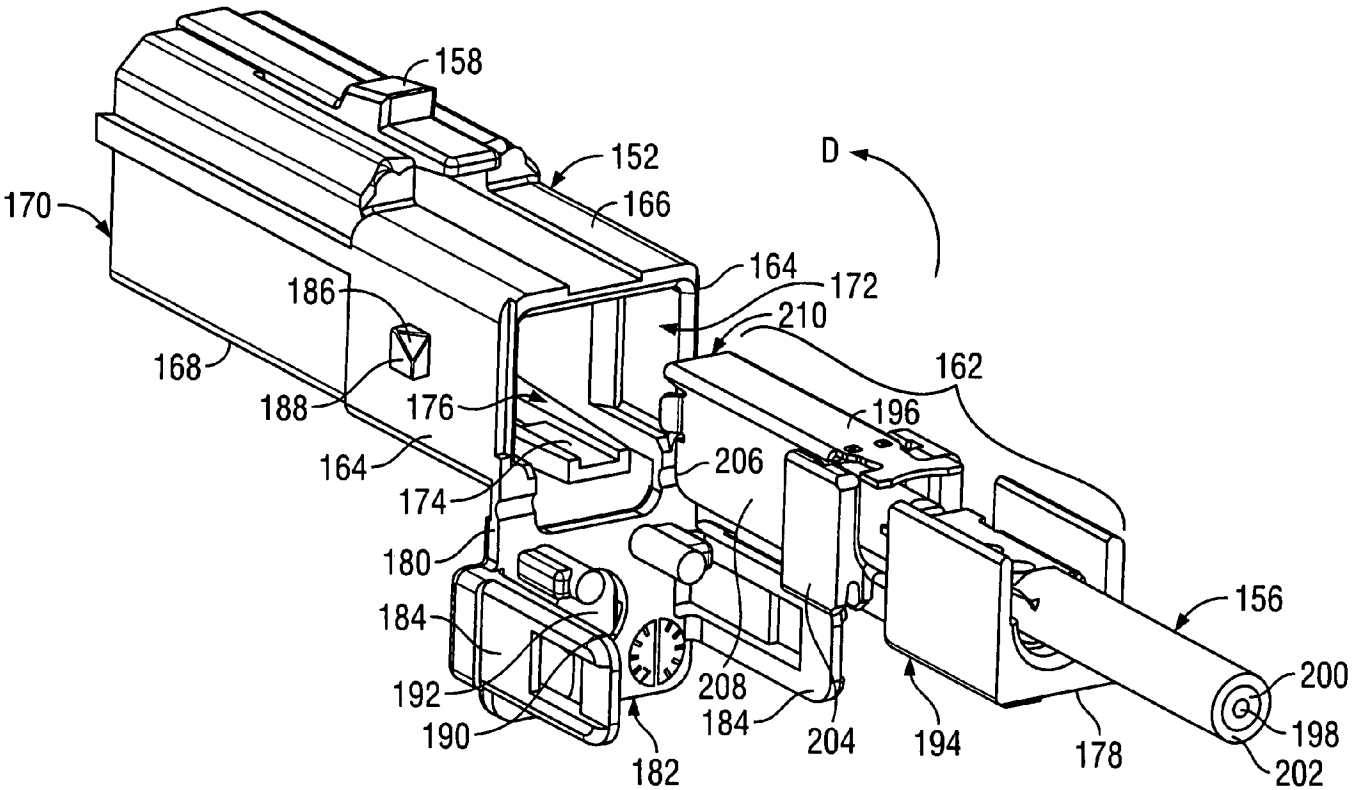
FIG. 3 (Prior Art)
FIG. 3 is an exploded view of a plug housing, coaxial cable, and dielectric subassembly for the connector assembly shown in FIG. 2.

FIG. 3 is an exploded view of the plug housing 152, the corresponding coaxial cable 156, and a dielectric subassembly 162. The plug housing 152 is defined by opposite side walls 164 formed with top and bottom walls 166 and 168 that include a mating end 170 and a reception end 172. The top wall 166 includes the deflectable latch 158. The bottom wall 168 includes a prong 174 with guide beams 176 extending inward within the plug housing 152. The guide beams 176 are aligned with, and slidably receive, the dielectric subassembly 162 along a rear wall 178 as the dielectric subassembly 162 is inserted into the plug housing 152. The guide beams 176 properly orient and retain the dielectric subassembly 162 within the plug housing 152.

The bottom wall 168 also includes hinges 180 that extend to an opened hatch 182. Retention latches 184 extend perpendicularly from the hatch 182 opposite each other. The retention latches 184 slide over sloped faces 186 of latch catches 188 extending from the side walls 164 and receive the latch catches 188 when the hatch 182 is rotated approximately 180 degrees in the direction of arrow D to close the reception end 172. Additionally, the hatch 182 includes a gap 190 leading to a cable hole 192 through which the coaxial cable 156 extends when positioned within the plug housing 152 and the dielectric subassembly 162.

The dielectric subassembly 162 includes a plastic dielectric 194 connected to a rectangular metal outer shield 196. The dielectric subassembly 162 receives and retains the coaxial cable 156. The coaxial cable 156 includes a central conductor 198 concentrically surrounded by a dielectric material 200 which in turn is concentrically surrounded by a cable braid 202 that serves as a ground pathway. The coaxial cable 156 also typically includes a jacket around the cable braid (not shown in FIG. 3). The dielectric 194 includes a leading portion 204 that engages catches (not shown) on the side walls 164 inside the plug housing 152 that retain the dielectric subassembly 162 therein. The outer shield 196 includes coaxial cable displacement contacts that extend into the cable braid 202 to join the ground pathway. The outer shield 196 also includes anti-stubbing members 206 extending from a side wall 208 proximate an interface end 210 of the dielectric subassembly 162. The anti-stubbing members 206 engage corresponding anti-stubbing members (not shown) of a similar dielectric subassembly (not shown) within the receptacle housing 154 (shown in FIG. 2) such that the outer shield 196 overlaps a similar outer shield (not shown) within the receptacle housing 154.

A plug contact (not shown in FIG. 2 but similar to the plug contact 106 shown in FIG. 1) within the dielectric subassembly 162 engages the conductor 198 of the coaxial cable 156 to join the electric signal pathway. A rectangular front portion extends from the dielectric 194 and separates the plug contact from the outer shield 196 at the interface end 210.

Figure 4:
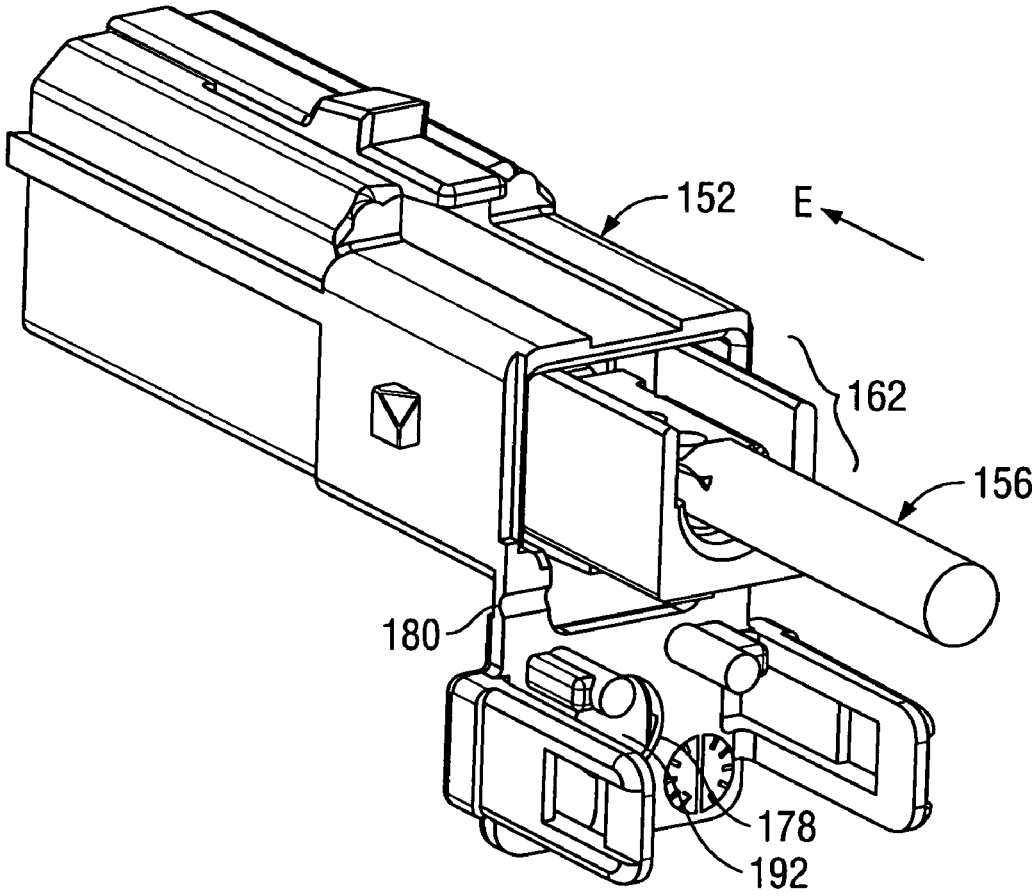
FIG. 4 (Prior Art)
FIG. 4 is a perspective view of the coaxial cable and dielectric subassembly shown in FIG. 2 partially assembled.

In operation, and as shown in FIG. 4, the dielectric subassembly 162 retaining the coaxial cable 156 is inserted in the direction of arrow E into the plug housing 152. When the dielectric subassembly 162 is fully inserted into the plug housing 152, the hatch 182 is closed by rotating about the hinges 180 in the direction of arrow D (shown in FIG. 3). As the hatch 182 is closed, the coaxial cable 156 is contained within the gap 190 and slides therethrough into the cable hole 192. Additionally, as the hatch 182 is closed, the retention latches 184 slide along the side walls 164 and deflect outward away from each other about the sloped faces 186 until receiving the latch catches 188, thus holding the hatch 182 closed about the dielectric subassembly 162.

The receptacle housing 154 (shown in FIG. 2) is constructed similarly to the plug housing 152, and when the plug housing 152 is inserted into the receptacle housing as shown in FIG. 2, the receptacle contact is electrically coupled to the plug contact and the respective cables of the plug and receptacle are electrically connected.

Figure 5:
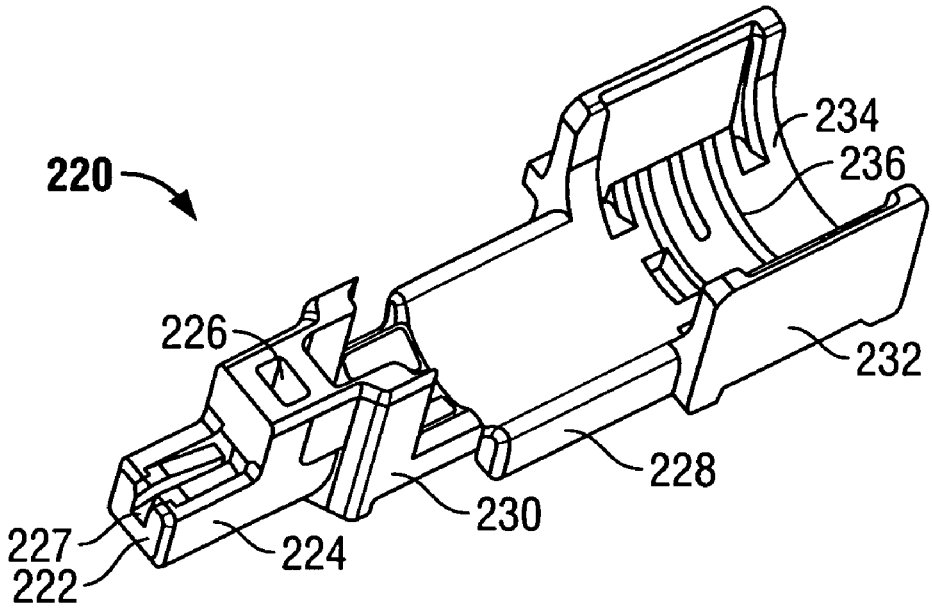
FIG. 5 is a perspective view of a plug dielectric formed in accordance with an exemplary embodiment of the present invention.

FIG. 5 is a perspective view of a plug dielectric 220 formed in accordance with an exemplary embodiment of the present invention. The dielectric 220 includes a mating face 222 on a front end of a rectangular body section 224. The body section 224 is adapted to receive a leading end of a coaxial cable (not shown in FIG. 5) and a portion of a plug contact described below. A front end of the body section 224 includes a slot 227 that accepts a portion of the plug contact. A rear end of the body section 224 is formed with a shroud 229 through a joining section 230. The shroud 229 supports the coaxial cable.

A rear end of the shroud 229 is joined with a strain relief member 232 having an inner surface 234 having transverse arcuate grooves 236. The inner surface 234 of the strain relief member 232 and the shroud 229 form a substantially continuous surface which receives and supports a coaxial cable.

Figure 6:
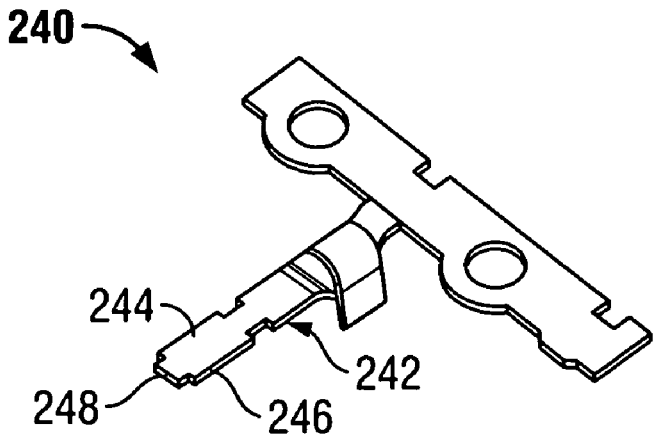
FIG. 6 is a perspective view of a plug contact for the dielectric shown in FIG. 5.

FIG. 6 is a perspective view of a plug contact 240 for use with the dielectric 220 (shown in FIG. 5). The plug contact 240 includes a planar body section 242 with a top surface 244 and a bottom surface 246. The planar body section 242 has a beveled outer end 248 for engagement with a receptacle contact described below.

Figure 7:
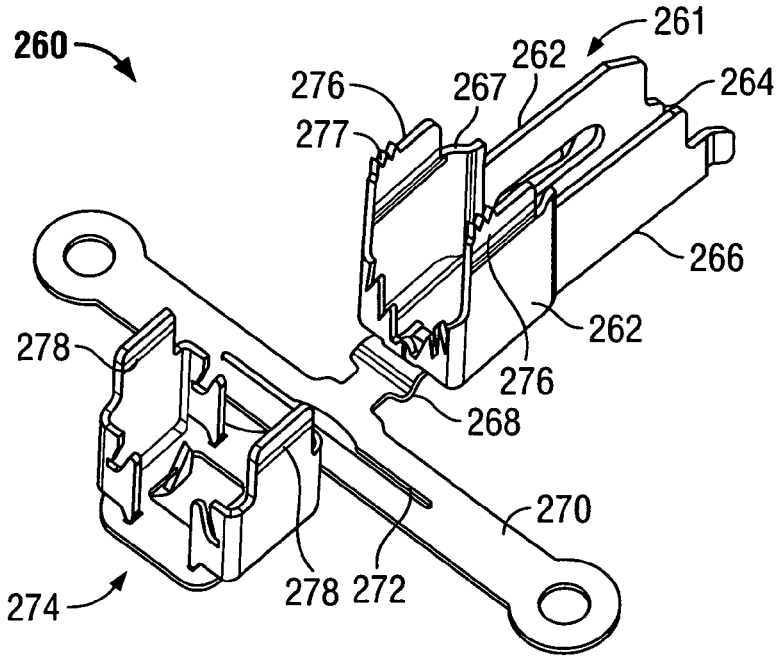
FIG. 7 is a perspective view of a plug shield formed in accordance with an exemplary embodiment of the present invention.

FIG. 7 is a perspective view of an exemplary plug shield 260 formed in accordance with an exemplary embodiment of the present invention. The plug shield includes an elongated reception portion 261 having side walls 262 with a top surface 264 and a connecting wall 266 extending between the side walls 262.

A pair of tabs 267 extend from the top surfaces 264 of the side walls 262. Since the tabs 267 extend higher than the side walls 262, they serve to create a low impedance path between the coaxial cable braid and the shield of the connector.

The connecting wall 266 includes a transition region 268 at a rear end thereof that is formed integrally with a laterally extending carrier strip or separation plate 270. The separation plate 270 includes a slot 272 to facilitate cutting of the separation plate 270 for installation of the shield 260. The separation plate 270 is, in turn, formed integrally with a strain relief crimp 274. During assembly, the strain relief crimp 274 is physically separated from the transition region 268, such as through a stamping operation, and then secured to the coaxial cable.

Secondary shielding flaps 276 are formed integrally with the side walls 262 of the plug contact 260 between the tabs 267 and the transition region 268. The flaps 276 include a serrated edge 277 on a portion thereof. The serrated edge 277 provides rough projections or teeth which grip the cable braid as the shield 260 is installed. As will be explained below, the flaps 276 are folded over the coaxial cable to provide secondary shielding for larger cable as well as to provide mechanical stability of the connection between the shield 260 and the coaxial cable. The side walls 262 and the connecting wall 266 provide primary shielding while the flaps 276 provide secondary shielding. Optionally, the strain relief crimp 274 also includes flaps 278 for added mechanical stability when the strain relief crimp 274 is installed.

Figure 8:
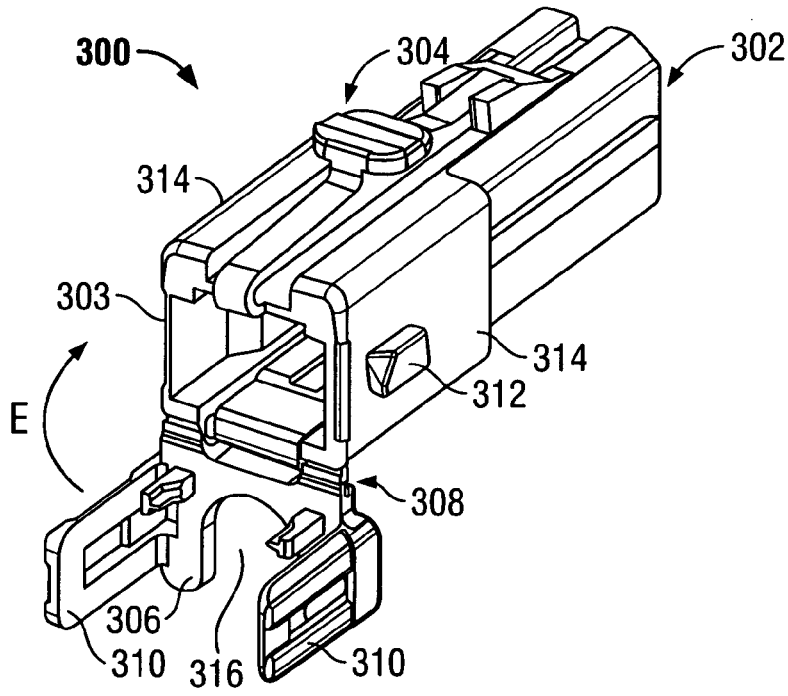
FIG. 8 is a perspective view of a plug outer housing for the dielectric, contact, and shield shown in FIGS. 5-7.

FIG. 8 is a perspective view of a plug housing 300 for the dielectric 220 (shown in FIG. 5) the plug contact 240 (shown in FIG. 6) and the shield 260 (shown in FIG. 7), which collectively form a plug assembly which capably connects larger cables.

The plug housing 300 is configured to mate with a receptacle housing described below. The plug housing 300 includes a mating end 302 adapted to be inserted into a mating end of the receptacle housing, and a reception end 303 adapted to receive the plug dielectric 220 and associated plug contact 240, plug shield 260, and cable (not shown in FIG. 8). A latch beam 304 is provided in one side of the plug housing 300 which engages a slot in the receptacle housing when the plug housing 300 and the receptacle housing are joined.

The reception end 303 includes a rotatable hatch 306 mounted upon a hinge 308. Retention latches 310 extend from the hatch 306, and when the hatch 306 is rotated approximately 180 degrees in the direction of arrow E to close the reception end 303, the retention latches 310 engage latch catches 312 on each side wall 314 of the plug housing 300. A cable opening 316 is provided in the latch 306 which receives and supports a cable (not shown in FIG. 8) when the hatch 306 is closed.

Figure 9:
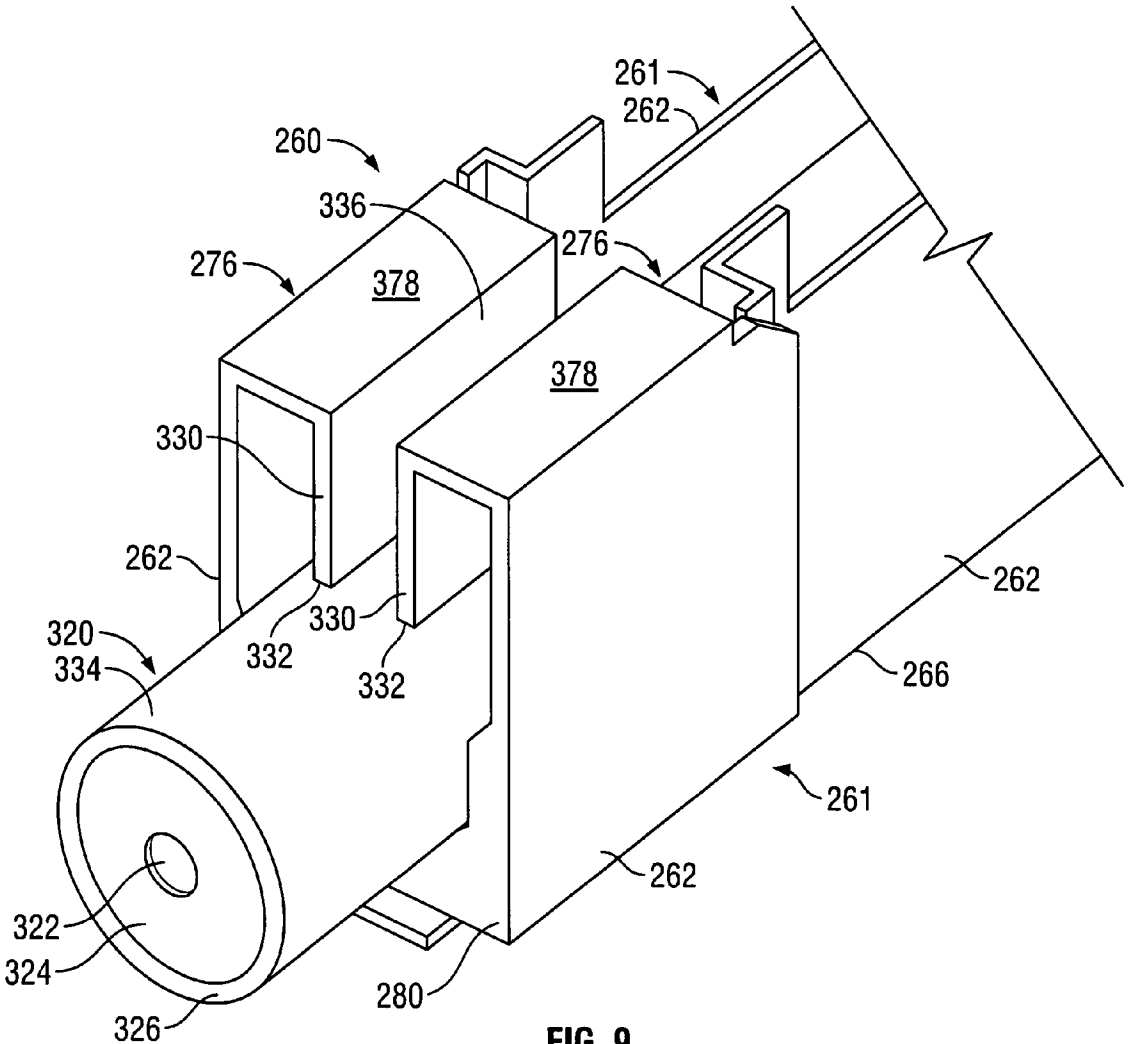
FIG. 9 is a perspective assembly view of a portion of the plug shield shown in FIG. 7 coupled to a coaxial cable.

FIG. 9 is a perspective assembly view of a portion of the plug shield 260, and more specifically the reception portion 261 of the plug shield shown 260, coupled to a coaxial cable 320. As with known cables, the cable 320 includes a center conductor 322, a dielectric material 324 surrounding the center conductor 322, and a conductive braid 326 overlaying the dielectric material 324. An insulative cable jacket (not shown in FIG. 9) is provided over the cable braid 326, but as illustrated in FIG. 9, the cable jacket has been stripped from the cable 320 to reduce the diameter of the cable.

The reception portion 261 is separated from the strain relief crimp 274 (shown in FIG. 7) at the transition region 268, and the cable 320 is received in the reception portion 261 of the plug shield 260 between the side walls 262 and over the connecting wall 266. The coaxial cable displacement section 280 grips the cable braid 326 at one end of the reception portion 261 of the shield 260, and the reception portion 261 forms a three sided enclosure surrounding the cable 320. The flaps 276 are folded over the top of the cable 320 opposite the connecting wall 266 such that the flaps 276 include a top section 378, and a connecting portion 330 extending substantially parallel to the side walls 262. As such, the flaps 276 define a fourth side of the enclosure about the cable 320. An end 332 of the connecting portion 330 of the flaps 276 contacts an outer surface 334 of the braid 326 and therefore provides a conductive, low impedance path to ground. The serrated edge 277 of each of the flaps 276 grips the cable braid 326 and prevents relative movement of flaps 276 with respect to the cable.

In operation, the side walls 262 and the connecting wall 266 provide primary shielding about three sides of the cable 320, and the flaps 276 provide shielding along the remaining fourth side of the cable 320. As such, the flaps 276 provide an additional low impedance path between the coaxial cable braid and the connector shield. As the flap ends 332 are electrically connected to the cable braid 326, the current is provided a low impedance path between the cable braid 326 and the connector shield 260.

In the illustrated embodiment, the flaps 276 are integrally formed with the reception portion 261 and are folded into the configuration shown in FIG. 9 in a crimping operation when the reception portion 261 is attached to the cable 320. The connecting portions 330 of the flaps 276 are separated by a gap 336 which facilitates connection of the flaps 276 to the cable braid 326 while still providing adequate secondary shielding about the fourth side of the cable 320. In an alternative embodiment, one or more flaps 276 may be a separately formed element from the reception portion 261 and connected to the reception portion 261 of the shield 260 to provide secondary shielding for the cable connection.

In one embodiment, the ends 332 of the flaps 276 rest upon the outer surface 334 of the cable braid 326 and the flaps 276 are clamped to the braid 326 during the crimping process. In another embodiment, the ends 332 of the flaps penetrate the braid 326 and engage the dielectric material 324 of the cable 320. In still another embodiment, the ends 332 of the flaps 276 penetrate the jacket of the cable 320 and electrically connect to the braid 326 to carry current from the braid 326 to the connector shield 260.

The flaps 276 (shown in FIG. 7) of the strain relief crimp 274 may also be folded about the cable similar to the flaps 276 as illustrated in FIG. 9 to more securely couple the strain relief crimp 274 to the cable 320.

Figure 10:
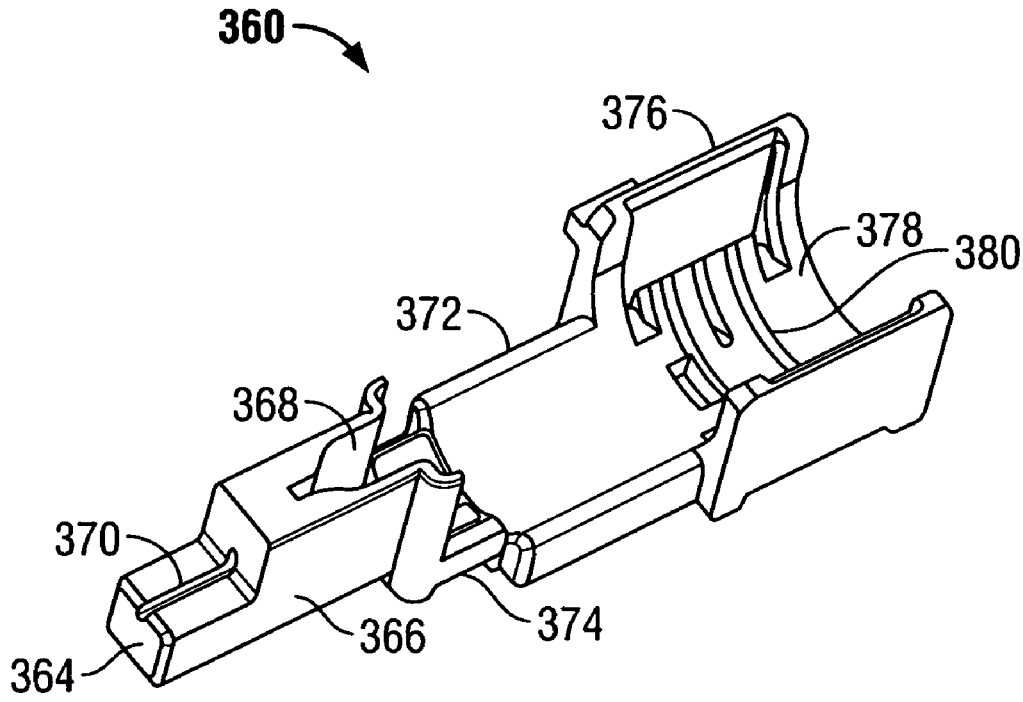
FIG. 10 is a perspective view of a receptacle dielectric formed in accordance with an exemplary embodiment of the present invention.

FIG. 10 is a perspective view of a receptacle dielectric 360 formed in accordance with an exemplary embodiment of the present invention. The dielectric 360 includes a mating face 364 on a front end of a rectangular body section 366. The body section 366 includes a cavity 368 adapted to receive a leading end of a coaxial cable, such as a cable similar to cable 320 (shown in FIG. 9), and a portion of a receptacle contact (not shown in FIG. 10 but described below). A front end of the body section 366 includes a slot 370 that accepts a portion of the receptacle contact. A rear end of the body section 366 is formed with a shroud 372 through a joining section 374. The shroud 372 receives and supports the coaxial cable.

A rear end of the shroud 372 is joined with a strain relief member 376 having an inner surface 378 including transverse arcuate grooves 380. The inner surface 378 of the strain relief member 376 and the shroud 372 form a substantially continuous surface which receives and supports a coaxial cable.

Figure 11:
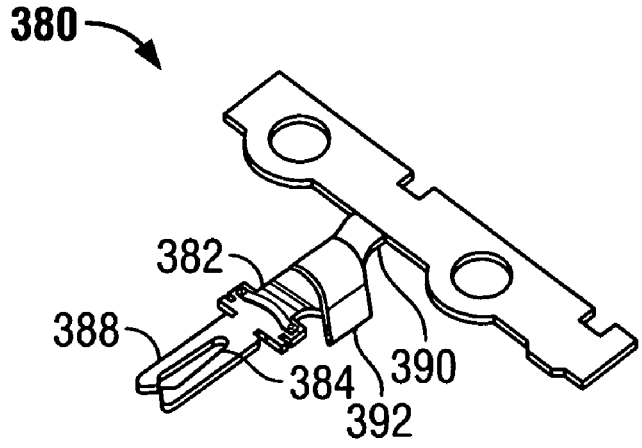
FIG. 11 is a perspective view of a receptacle contact for the dielectric shown in FIG. 10.

FIG. 11 is a perspective view of a receptacle contact 380 for use with the dielectric 360 (shown in FIG. 10). The receptacle contact 380 includes a substantially planar body section 382 with a top surface 384 and a bottom surface 386. The planar body section 382 has a forked outer end 388 for engagement with the plug contact 240 (shown in FIG. 6). A wire barrel 392 extends between the opposed ends 388, 390 of the receptacle contact 380, is crimped to the center conductor, and establishes electrical connection with the coaxial cable. When engaged to the dielectric 360, the outer end 388 of the receptacle contact 380 is located within the slot 370 (shown in FIG. 10) for engagement with the plug contact 240 (shown in FIG. 6) when the plug dielectric 220 and the receptacle dielectric 360 are mated.

Figure 12:
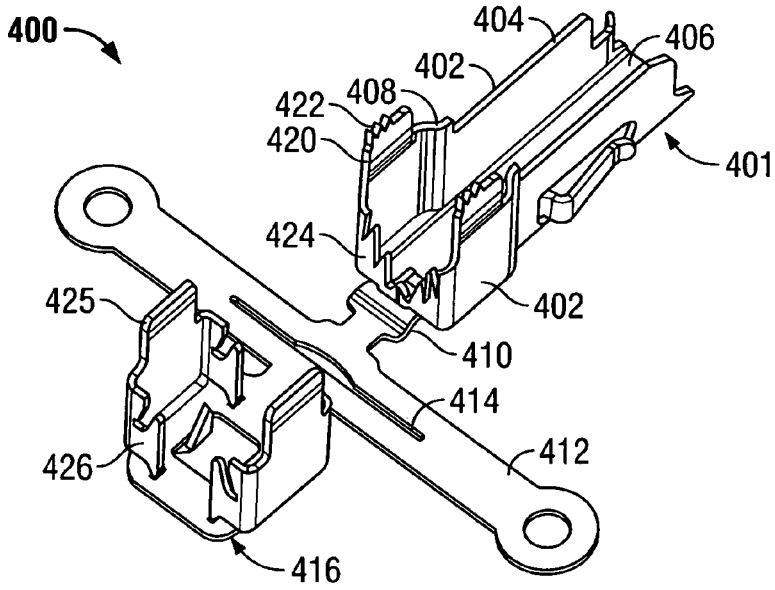
FIG. 12 is a perspective view of a receptacle shield formed in accordance with an exemplary embodiment of the present invention.

FIG. 12 is a perspective view of an exemplary receptacle shield 400 formed in accordance with an exemplary embodiment of the present invention. The receptacle shield 400 includes a reception portion 401 having side walls 402 with a top surface 404 and a connecting wall 406 extending between the side walls 402.

A pair of tabs 408 extend from the top surfaces 404 of the side walls 402. Since the tabs 408 extend higher than the side walls 402, they provide a low impedance path between the coaxial cable braid and the shield of the connector.

The connecting wall 406 includes a transition region 410 at a rear end thereof that is formed integrally with a laterally extending carrier strip or separation plate 412. The separation plate 412 includes a slot 414 to facilitate cutting of the separation plate 412 from the shield. The separation plate 412 is in turn formed integrally with a strain relief crimp 416. During assembly, the strain relief crimp 416 is physically separated from the transition region 410, such as through a stamping operation, and then secured to the coaxial cable.

Secondary shield flaps 420 are formed integrally with the side walls 402 of the reception portion 401 of the receptacle shield 400. The flaps 420 are formed between the tabs 408 and the transition region 410, and the flaps 420 include serrated edges 422 on portions thereof. The flaps 420 are folded over the coaxial cable to provide secondary shielding as well as to provide mechanical stability of the connection between the shield 400 and the coaxial cable as substantially described above in relation to FIG. 9. The side walls 402 and the connecting wall 406 provide primary shielding while the flaps 420 provide secondary shielding as described above in relation to FIG. 9. Optionally, the strain relief crimp 416 also includes flaps 425 for added mechanical stability when the strain relief crimp 416 is installed.

An coaxial cable displacement section 424 extends between the side walls 402 adjacent the transition region 410 for gripping the cable as the shield 400 is installed. Sections 426 are also provided on the opposite ends of the strain relief crimp 416 as specially designed mechanical sections for penetrating the jacket and engaging all components of the coaxial cable.

Figure 13:
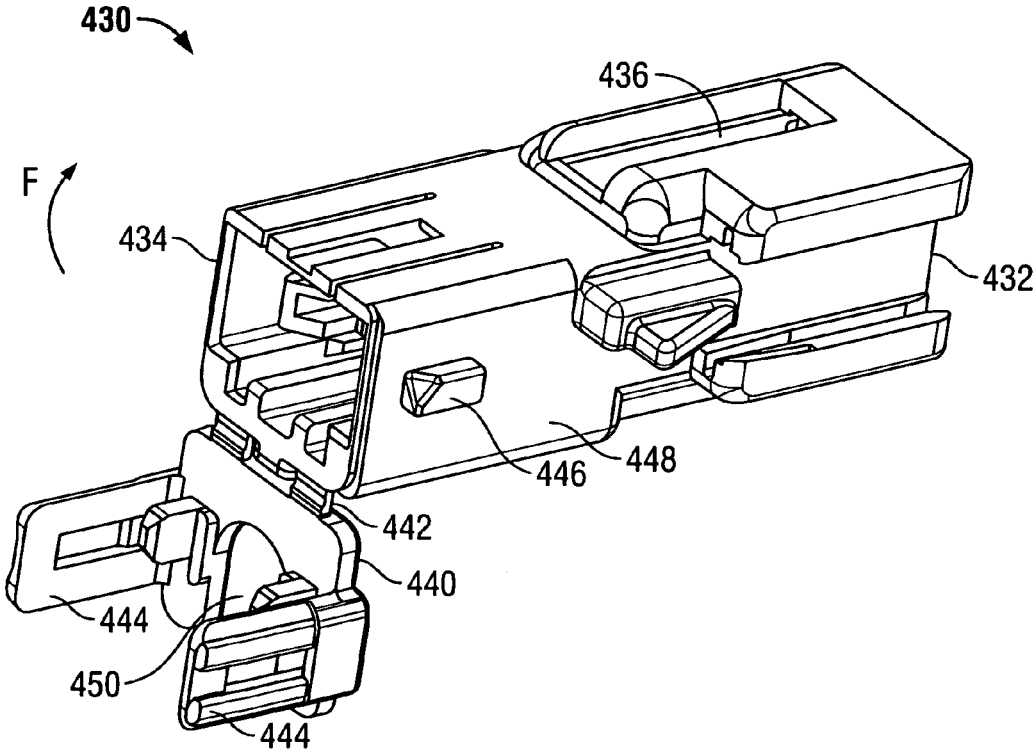
FIG. 13 is a perspective view of a receptacle outer housing for the dielectric, contact, and shield shown in FIGS. 10-12.

FIG. 13 is a perspective view of a receptacle housing 430 for the dielectric 360 (shown in FIG. 10), the receptacle contact 380 (shown in FIG. 11), and the shield 400 (shown in FIG. 12), to collectively form a receptacle assembly which capably connects larger cables.

The receptacle housing 430 is configured to mate with the plug housing 300 (shown in FIG. 8). The receptacle housing 430 includes a mating end 432 adapted to receive the mating end 302 (shown in FIG. 8) of the plug housing 300, and a reception end 434 adapted to receive the receptacle dielectric 360 and associated receptacle contact 380, receptacle shield 400, and a cable (not shown in FIG. 13). A slot 436 is provided in one side of the receptacle housing 430 which engages the latch beam 304 (shown in FIG. 8) of the plug housing 300 when the receptacle housing 430 and the plug housing 300 are joined.

The reception end 434 includes a rotatable hatch 440 mounted upon a hinge 442. Retention latches 444 extend from the hatch 440, and when the hatch 440 is rotated approximately 180 degrees in the direction of arrow F to close the reception end 434, the retention latches 444 engage latch catches 446 on each side wall 448 of the receptacle housing 430. A cable opening 450 is provided in the latch 444 which receives a cable (not shown in FIG. 13) when the hatch 440 is closed to complete the receptacle assembly.

A plug assembly and a receptacle assembly is therefore provided, each of which includes secondary shielding for capably accommodating larger cables. The plug shield 260 and the receptacle shield 400 are securely coupled to the respective cables of the plug assembly and the receptacle assembly for reliable shielding. The secondary shielding flaps of the plug shield 260 and the receptacle shield 400 provide a direct low impedance path between the conductive braid 326 and the connector shield 402. Signal integrity is ensured and losses are minimized.

Figure 14:
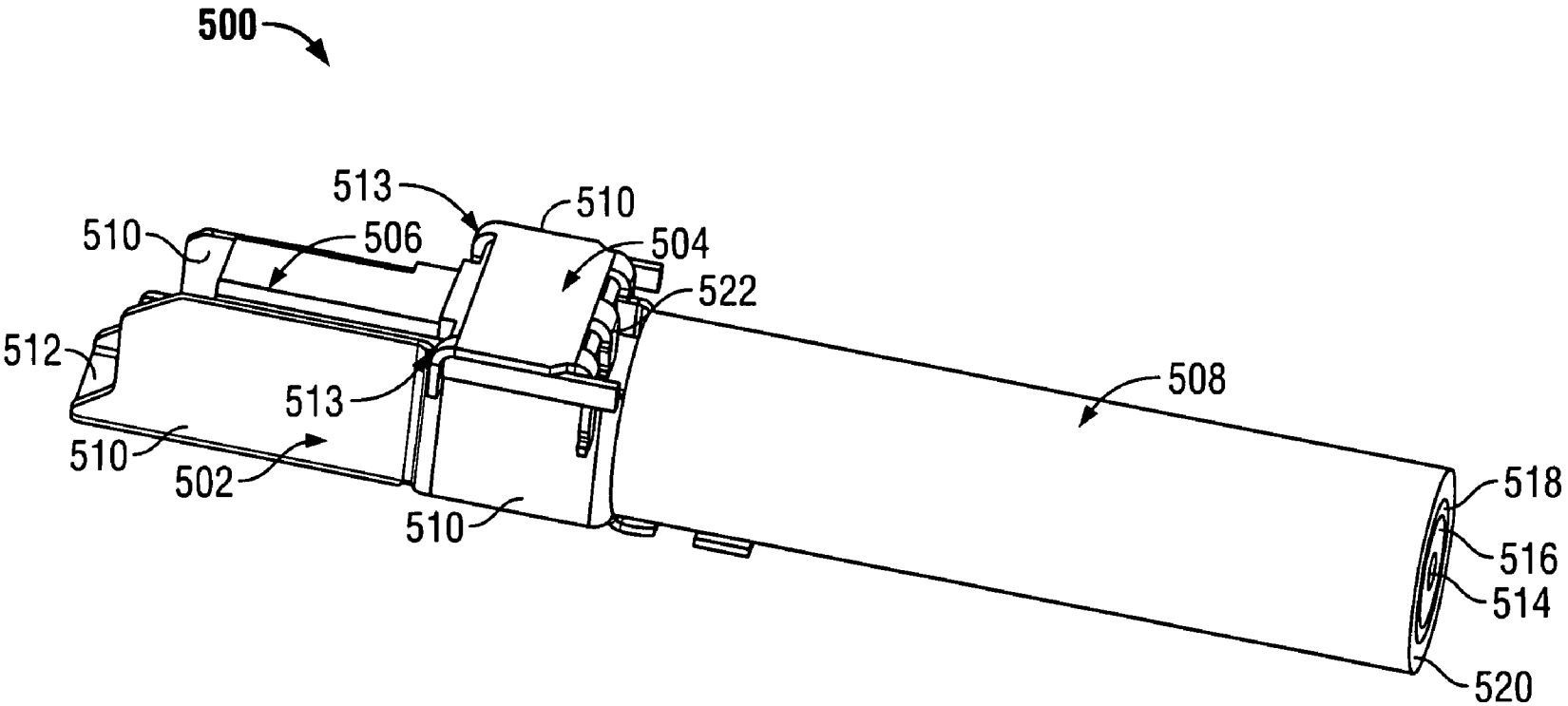
FIG. 14 is a perspective view of a coaxial cable connector assembly formed in accordance with an alternative embodiment of the present invention.
Figure 15:
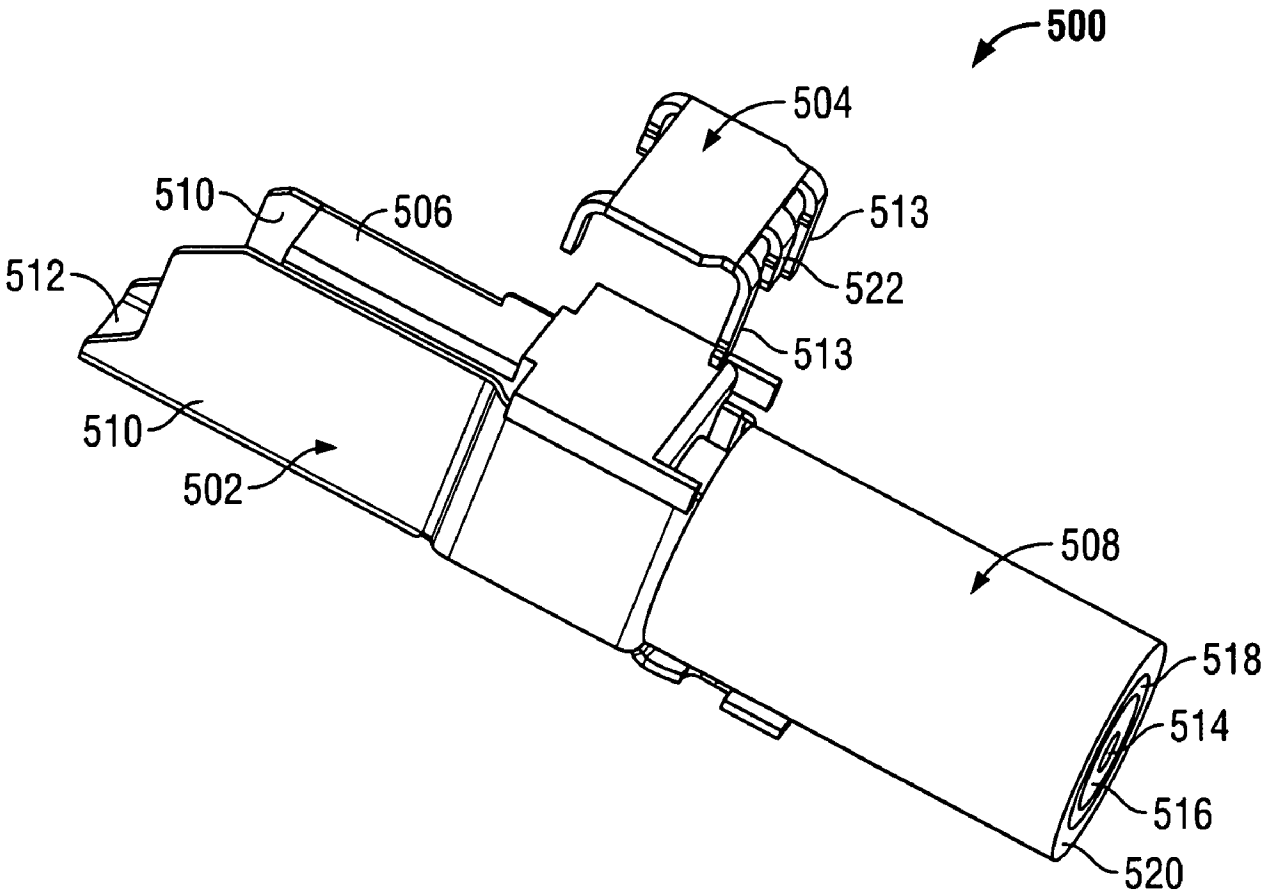
FIG. 15 is an exploded view of the coaxial cable connector shown in FIG. 14.

FIGS. 14 and 15 are a perspective and exploded view, respectively of a portion of a coaxial cable connector assembly 500 formed in accordance with an alternative embodiment of the present invention. The assembly 500 includes a primary shield 502, a secondary shield 504, a dielectric 506, a contact (not shown) associated with the dielectric 506, and a coaxial cable 508. An outer housing (not shown in FIG. 14) may be provided to enclose the assembly 500 substantially as described above.

The primary shield 502 includes side walls 510 and a connecting wall 512 therebetween which provide shielding about three sides of the cable connection. The secondary shield 504 is provided over the top of the side walls 510 opposite the connecting wall 512 and provides shielding on the fourth side of the cable 508. The secondary shield 504 is electrically connected to the primary shield at contact points 513 as well as to the coaxial cable braid at the contact point 522.

The cable 508 includes a center conductor 514, a dielectric material 516 surrounding the conductor 514, a conductive braid 518 over the dielectric material 516, and an insulative jacket 520 surrounding the cable braid. The center conductor 514 is electrically connected to the contact associated with the dielectric 506 substantially as described above, and the secondary shield 504 includes a contact point 522 extending therefrom which electrically contacts the cable braid 518. In the illustrated embodiment, the secondary shield 504 is separately fabricated from the primary shield 502 and is mechanically coupled thereto by known methods and techniques, although it is contemplated that the secondary shield 504 may be integrally formed and folded over the top of the cable 508 in an alternative embodiment if desired.

Operationally, the secondary shield provides a low impedance path between the primary shield 502 and the coaxial cable braid 518. Consequently, the assembly 500 provides similar benefits and advantages as the embodiment described above in FIGS. 5-13.

Figure 16:
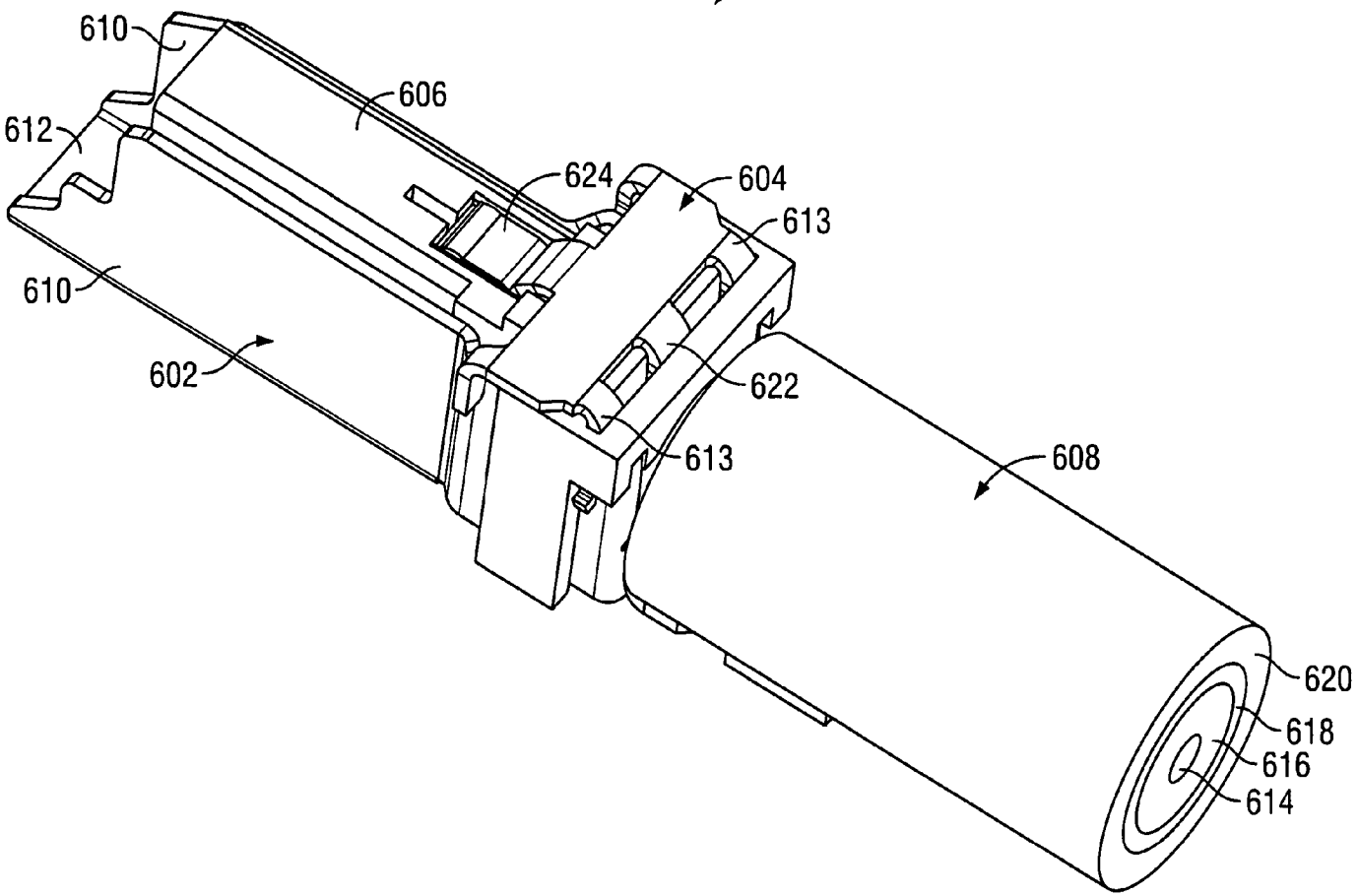
FIG. 16 is an assembly view of another embodiment of a coaxial cable assembly formed in accordance with an embodiment of the present invention.

FIG. 16 is an assembly view of another embodiment of a coaxial cable assembly 600 formed in accordance with an embodiment of the present invention.

The assembly 600 includes a primary shield 602, a secondary shield 604, a dielectric 606, a contact (not shown) associated with the dielectric 606, and a coaxial cable 608. An outer housing (not shown in FIG. 16) may be provided to enclose the assembly 600 substantially as described above.

The primary shield 602 includes side walls 610 and a connecting wall 612 therebetween which provide shielding about three sides of the cable connection. The secondary shield 604 is provided over the top of the side walls 610 opposite the connecting wall 612 and provides shielding on the fourth side of the cable 608. The secondary shield 604 is electrically connected to the primary shield at contact points 613 as well as to the coaxial cable braid at the contact point 622.

The cable 608 includes a center conductor 614, a dielectric material 616 surrounding the conductor 614, a conductive braid 618 over the dielectric material 616, and an insulative jacket 620 surrounding the cable braid 618. The center conductor 614 is electrically connected to the contact associated with the dielectric 606 substantially as described above, and the secondary shield 604 includes a contact point 622 extending therefrom which electrically contacts the cable braid 618.

Operationally, the secondary shield 604 provides a low impedance path between the primary shield 602 and the coaxial cable braid 618. Consequently, the assembly 600 provides similar benefits and advantages as the embodiment described above in FIGS. 14 and 15.

Additionally, the secondary shield 604 includes a contact finger 624 which extends from a center of the secondary shield opposite the contact points 613 and the contact point 622. The finger 624 touches and establishes electrical contact with a shield (not shown) of the opposite half of the connector as it is mated to the assembly 600. The contact finger therefore provides an additional current path for reliable shielding to preserve signal integrity and minimize signal loss.

In accordance with the previous embodiments, the secondary shield 604 may be separately fabricated from the primary shield 602 and mechanically coupled thereto by known methods and techniques, or the secondary shield 604 may be integrally formed and folded over the top of the cable 608.

While the invention has been described in terms of various specific embodiments, those skilled in the art will recognize that the invention can be practiced with modification within the spirit and scope of the claims.

What is claimed is:

1. A coaxial cable connector assembly comprising:

a coaxial cable comprising a conductive braid; and a primary shield coupled to said cable and in electrical contact with said conductive braid, wherein said primary shield comprises opposite non-folded side walls and a connecting wall extending between said side walls to define a three sided enclosure surrounding said cable, wherein said side walls include top edges that face upward away from said enclosure, said enclosure having a fourth open side; and a secondary shield extending over and closing said fourth open side of said enclosure opposite to said connecting wall, said secondary shield being directly connected to said conductive braid, and said secondary shield coupled to said primary shield such that said secondary shield provides a low impedance path between said conductive braid and said primary shield.

2. A coaxial cable connector assembly in accordance with claim 1 wherein said secondary shield comprises a first contact finger configured to pierce at least one of said conductive braid and a jacket surrounding said conductive braid.

3. A coaxial cable connector assembly in accordance with claim 1 wherein said secondary shield comprises a contact finger for connection to a shield of a mating connector.

4. A coaxial cable connector assembly in accordance with claim 1 wherein said primary and secondary shields form a square enclosure.

5. A coaxial cable connector assembly in accordance with claim 1, further comprising a dielectric held within said enclosure.

6. A coaxial cable connector assembly in accordance with claim 1, further comprising a dielectric held between said secondary shield and the coaxial cable.

7. A coaxial cable connector assembly in accordance with claim 1, further comprising a dielectric held between said secondary shield and the coaxial cable, said secondary shield having a contact finger that extends along a surface of said dielectric to electrically connect the conductive braid on the coaxial cable and the secondary shield.

8. A coaxial cable connector assembly in accordance with claim 1, farther comprising a dielectric held between said secondary shield and the coaxial cable, said secondary shield having first and second contact fingers that extend along a surface of said dielectric to engage said primary shield and the conductive braid on the coaxial cable, respectively.

9. A coaxial cable connector assembly comprising:

a plug assembly configured for mating engagement with a receptacle assembly, each of said plug assembly and said receptacle assembly configured to receive and connect a coaxial cable thereto, said cable comprising a conductive braid; and at least one of said plug assembly and said receptacle assembly comprising a primary shield coupled to said cable and in electrical contact with said conductive braid, said primary shield comprising opposite parallel non-folded side walls and a connecting wall defining an enclosure and surrounding said cable, wherein said side walls include top edges that face upward away from said enclosure, and a secondary shield extending at least partially over said cable opposite said connecting wall and mechanically and electrically connected to said conductive braid, and wherein said secondary shield is separately fabricated from said primary shield.

10. A coaxial cable connector assembly in accordance with claim 9 wherein said secondary shield comprises a contact finger configured to electrically connect at least one of said conductive braid on said coaxial cable and said primary shield.

11. A coaxial cable connector assembly in accordance with claim 9 wherein said primary and secondary shields form a square enclosure.

12. A coaxial cable connector assembly in accordance with claim 4, further comprising a dielectric held within said enclosure.

13. A coaxial cable connector assembly in accordance with claim 9, further comprising a dielectric held between said secondary shield and the coaxial cable.

14. A coaxial cable connector assembly in accordance with claim 9, further comprising a dielectric held between said secondary shield and the coaxial cable, said secondary shield having a contact finger that extends along a surface of said dielectric to electrically connect the conductive braid on the coaxial cable and the secondary shield.

15. A coaxial cable connector assembly in accordance with claim 9, further comprising a dielectric held between said secondary shield and the coaxial cable, said secondary shield having first and second contact fingers that extend along a surface of said dielectric to engage said primary shield and the conductive braid on the coaxial cable, respectively.

16. A coaxial cable connector assembly comprising:

a plug assembly configured for mating engagement with a receptacle assembly, each of said plug assembly and said receptacle assembly configured to receive and connect a coaxial cable thereto, said cable comprising a conductive braid;

at least one of said plug assembly and said receptacle assembly comprising a primary shield coupled to said cable and in electrical contact with said conductive braid, said primary shield comprising opposite side walls and a connecting wall to define an open sided enclosure that receives said cable, and a secondary shield extending over and closing an open side of the enclosure opposite to said connecting wall, the secondary shield being electrically connected to said primary shield, and wherein said secondary shield is separately fabricated from said primary shield; and a dielectric held within said enclosure and between said secondary shield and said coaxial cable, said secondary shield having a contact finger that extends along a surface of said dielectric to electrically connect the conductive braid on the coaxial cable and the secondary shield.

17. A coaxial cable connector assembly in accordance with claim 16 wherein said side walls include top edges that face upward away from said enclosure.

18. A coaxial cable connector assembly in accordance with claim 16 wherein said primary and secondary shields form a square enclosure.

* * * * *